United States Patent [19]

Carroll

[11] 3,937,327

[45] Feb. 10, 1976

[54] NESTING AND STACKING CONTAINERS

[75] Inventor: James C. Carroll, Bartlesville, Okla.

[73] Assignee: Phillips Petroleum Company, Bartlesville, Okla.

[22] Filed: July 29, 1974

[21] Appl. No.: 492,834

[52] U.S. Cl. ..... 206/507

[51] Int. Cl.[2] ..... B65D 21/04

[58] Field of Search ..... 206/506, 507, 505

[56] References Cited

UNITED STATES PATENTS

| | | | |
|---|---|---|---|
| 2,803,369 | 9/1957 | Fleetwood | 206/506 |
| 3,219,232 | 11/1965 | Wilson | 206/507 |
| 3,404,804 | 10/1968 | Frater | 206/505 |
| 3,481,507 | 12/1969 | Sanders | 206/507 |
| 3,773,213 | 11/1973 | Frederick | 206/507 |
| 3,825,114 | 7/1974 | Johnson | 206/507 |

*Primary Examiner*—George E. Lowrance

[57] ABSTRACT

A nesting and stacking container adapted to nest in a like oriented lower container of like construction, and stack on said lower container at two different elevations when rotated from said like orientation to different stations of rotation. The wall structures of said container are dissimilar and each comprises bar members which extend between the bottom and upper rim of the container. Each of said wall structures also comprises a first plurality of stacking feet and a first plurality of stacking saddles disposed in a first vertical plane located adjacent a side of said bottom, and a second plurality of stacking feet and a second plurality of stacking saddles disposed in a second vertical plane located adjacent but outside said first vertical plane.

10 Claims, 13 Drawing Figures

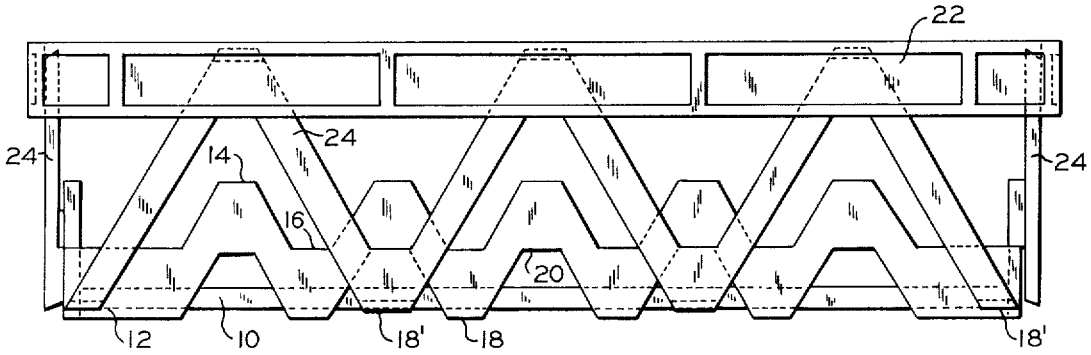
FIG. 3 (SIDE 1)
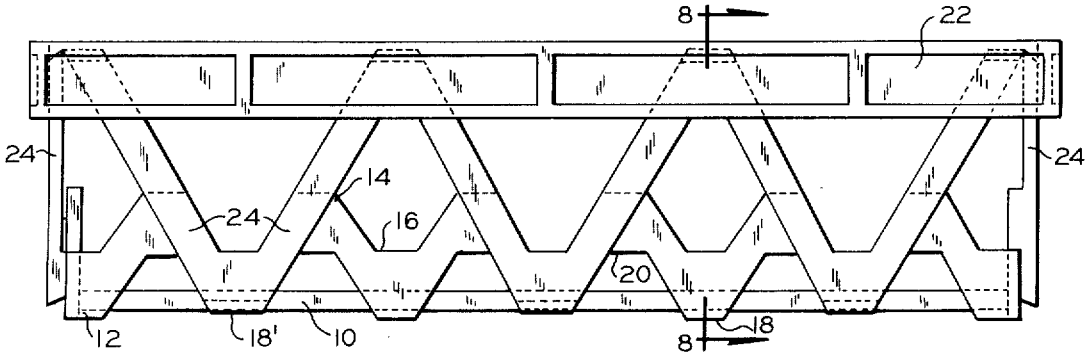
FIG. 4 (SIDE 2)
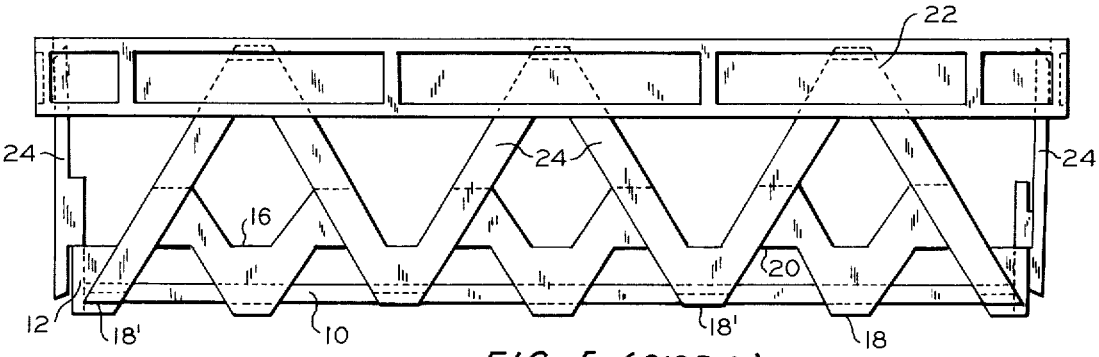
FIG. 5 (SIDE 3)
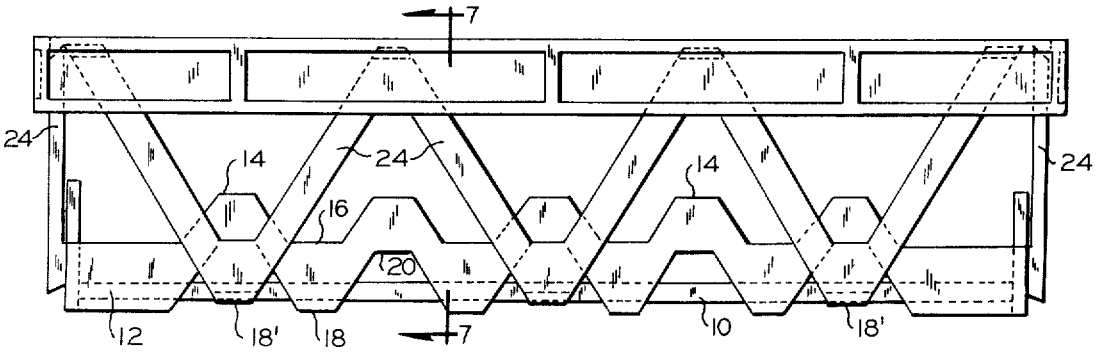
FIG. 6 (SIDE 4)

NESTING AND STACKING CONTAINERS

This invention relates to nesting and stacking containers.

Nesting and stacking containers are well known in the art. In general, such containers comprise an open, top, commonly rectangular, container so constructed that in one position an upper container will nest within a like oriented identical lower container for storage purposes. When said upper container is rotated to another position of orientation it will stack vertically on said lower container. Most commonly, the containers of the prior art will stack only upon being rotated through 180°. However, nesting and stacking containers are known which will stack upon being rotated through either 90° or 180°. Nesting and stacking containers are being employed in increasing numbers in a wide variety of applications such as product trays in the baking industry, lug boxes in the fruit and vegetable industry, as storage bins for parts, etc. In practically all of said uses it is desirable that the container be provided with maximum vertical support in the wall portions thereof so that when a number of filled containers are stacked vertically the lowermost containers in the stack will not be collapsed or become warped. It is also desirable that said containers be provided with convenient handle means for manual handling. Even though mechanical handling of such containers, and particularly the palletizing of groups of such containers, is being more and more widely employed, there are still steps in said mechanical handling operations where the containers must be handled manually. In many instances, it is further desirable that the containers be provided with substantially flat walls, if possible, to facilitate mechanical handling such as on conveyor belts, etc. It would also be highly desirable to have a container which can be stacked at more than one height. It is also desirable that said containers can be economically fabricated from moldable materials such as plastics and metals.

Attaining all of the above advantages or features in one container has been extremely difficult. The side and end walls of containers have been provided with corrugations or convolutions so as to provide increased vertical strength thereto. However, there has created problems in the handling of said containers due to interlocking of said corrugations or convolutions when the ends of containers encountered one another in use, as on conveyor belts or when placed side by side. Containers in the past have been commonly provided with handles by providing an opening in opposed walls. Such handle openings weaken said walls. Furthermore, such openings provide places where the contents of the container can be damaged, such as soft fruits and vegetables being damaged by the fingers of the person handling the container. Insofar as presently known, there are very few containers or trays commercially available which can be conveniently stacked at more than one height or elevation.

The present invention solves the above problems by providing a nesting and stacking container which is not subject to the above difficulties or limitations. The improved containers of the invention are provided with a wall structure which makes it possible to stack the containers at two different heights or elevations. Thus, the containers of the invention can be employed in handling a greater variety of products in a more economical and efficient manner. For example, in the handling of bakery products, the containers of the invention can be employed in a "full stack" position when filled with relatively high products, e.g., cakes or loaves of bread, or can be employed in a "half-stack" position when filled with products having a low height, e.g., rolls, pies, etc. Thus, a bakery operator can employ the containers of the invention in multiple uses and eliminate the need for stocking several different types of containers for different types of products. Other advantages of the containers of the invention will be discussed below in connection with the more detailed description of the containers.

Thus, according to the invention, there is provided a symmetrical nesting and stacking container comprising: a generally horizontally disposed bottom; a plurality of adjacent dissimilar wall structures extending upwardly to essentially the same height from adjacent essentially equal length peripheral segments of said bottom located around the periphery of said bottom; each of said wall structures comprising a first plurality of stacking feet disposed at spaced apart locations along a said peripheral segment of said bottom and in a first vertical plane located adjacent said peripheral segment, a first plurality of stacking saddles disposed at spaced apart locations above and alternating with said locations of said first stacking feet in said first vertical plane, a second plurality of stacking feet disposed at spaced apart locations along said peripheral segment of said bottom and in a second vertical plane which is adjacent but outside said first vertical plane, and a second plurality of stacking saddles disposed at spaced apart locations above and alternating with said locations of said second stacking feet in said second vertical plane at an elevation above that of said first stacking saddles; the location, arrangement, and lateral spacing of said first feet and said first saddles with respect to each other and to said second feet and said second saddles, together with the location, arrangement, and lateral spacing of said second feet and said second saddles with respect to each other and to said first feet and said first saddles being such that an upper said container will nest within a like lower container when said containers are in like positions of orientation; said second feet and said second saddles in at least two opposed said wall structures being adapted to register and to support an upper said container in a first stacked relationship on a like lower container when said upper container is rotated from said position of like orientation to a first station of rotation; and said first feet and said first saddles in at least two opposed said wall structures being adapted to register and to support an upper said container in a second stacked relationship on a like lower container at a lower elevation than that of said first stacked relationship when said upper container is further rotated to a second succeeding station of rotation.

In a presently preferred embodiment, the containers of the invention are essentially square. Thus, further according to the invention, there is provided a symmetrical essentially square nesting and stacking container, comprising a generally horizontally disposed bottom; and first, second, third, and fourth adjacent dissimilar side wall structures extending upwardly to essentially the same height from adjacent essentially equal length first, second, third, and fourth sides, respectively, of said bottom, with each of said wall structures comprising: a first plurality of stacking feet disposed at spaced apart locations along a said side of said bottom and in a first vertical plane located adjacent said side of said bottom; a first plurality of stacking saddles disposed at spaced apart locations in said first plane, at an elevation above, and alternating with, said locations of said first stacking feet in said first vertical plane; a second plurality of stacking feet disposed at spaced apart locations along said side of said bottom and in a second vertical plane which is adjacent but outside said first vertical plane; and a second plurality of stacking saddles disposed at spaced apart locations in said second plane, at an elevation above, and alternating with, said locations of said second stacking feet in said second vertical plane, said last mentioned elevation being greater than said elevation of said first stacking saddles; the location, arrangement, and lateral spacing of said first feet and said first saddles with respect to each other and with respect to said second feet and said second saddles, together with the location, arrangement, and lateral spacing of said second feet and said second saddles with respect to each other and with respect to said first feet and said first saddles being such that an upper said container will nest within a like lower container when said containers in like positions of orientation; said second feet and said second saddles in at least two opposed said wall structures being adapted to register and to support an upper said container in a first stacked relationship on a like lower container when said upper container is rotated from said position of like orientation to a first station of rotation; and said first feet and said first saddles in at least two opposed said wall structures being adapted to register and to support an upper said container in a second stacked relationship on a like lower container at a lower elevation than that of said first stacked relationship when said upper container is further rotated to a second succeeding station of rotation.

Figure 1:
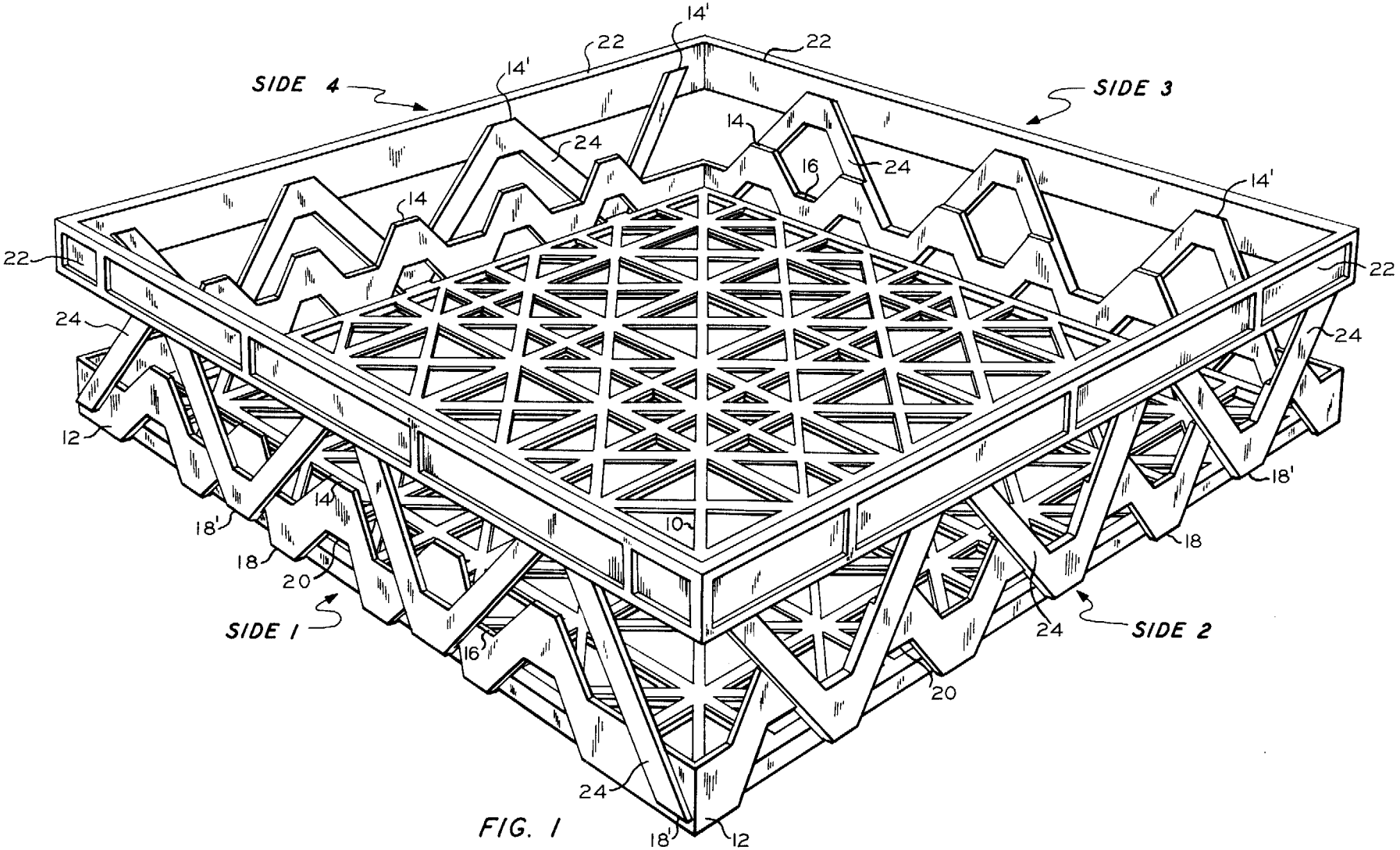
FIG. 1 is a top perspective view of one presently preferred container of the invention.
Figure 2:
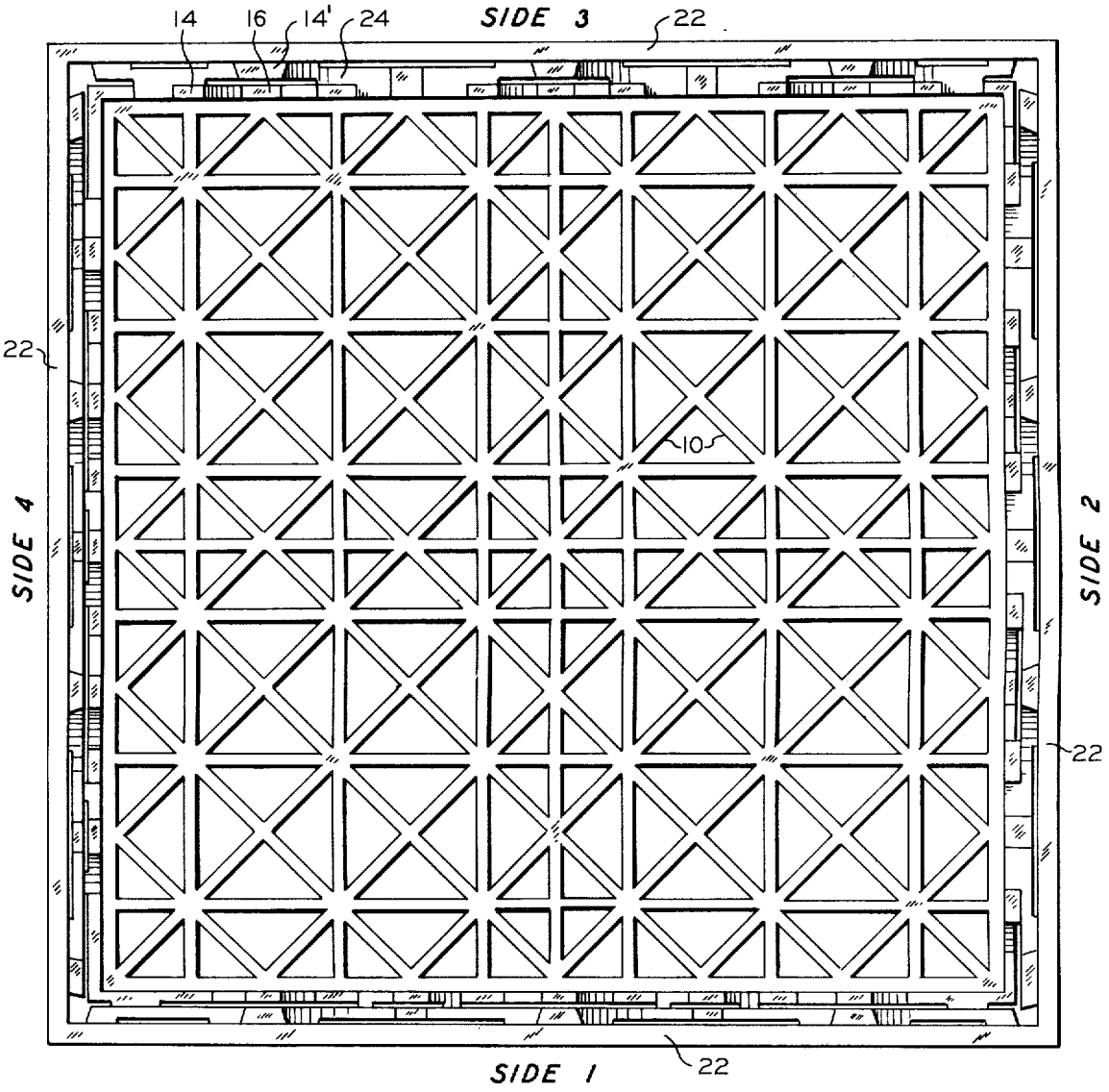
FIG. 2 is a top plan view of the container of FIG. 1.

FIGS. 3, 4, 5, and 6 are side elevational views of the four sides of the container of FIG. 1.

Figure 7:
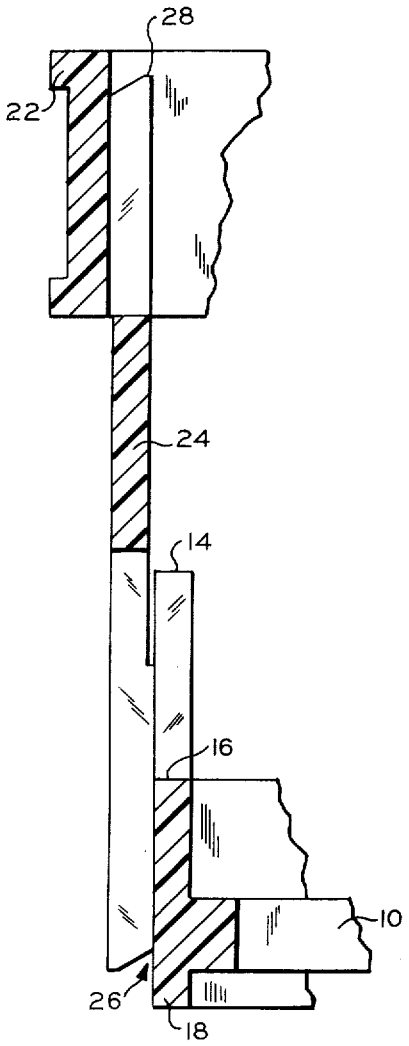
Figure 8:
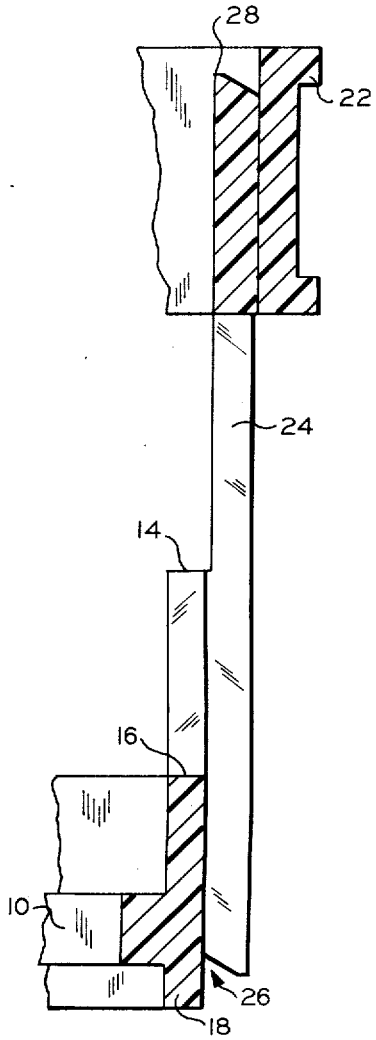

FIGS. 7 and 8 are enlarged sectional views taken along the lines 7—7 of FIG. 6 and lines 8—8 of FIG. 4, respectively.

Figure 9:
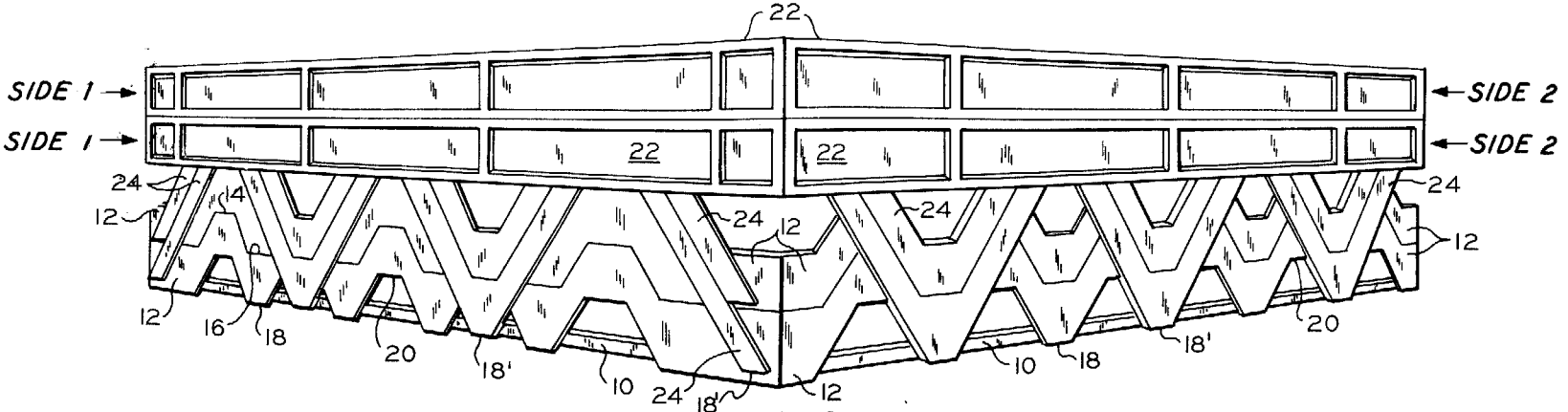

FIG. 9 is a side perspective view illustrating two containers of the invention in nested relationship.

Figure 10:
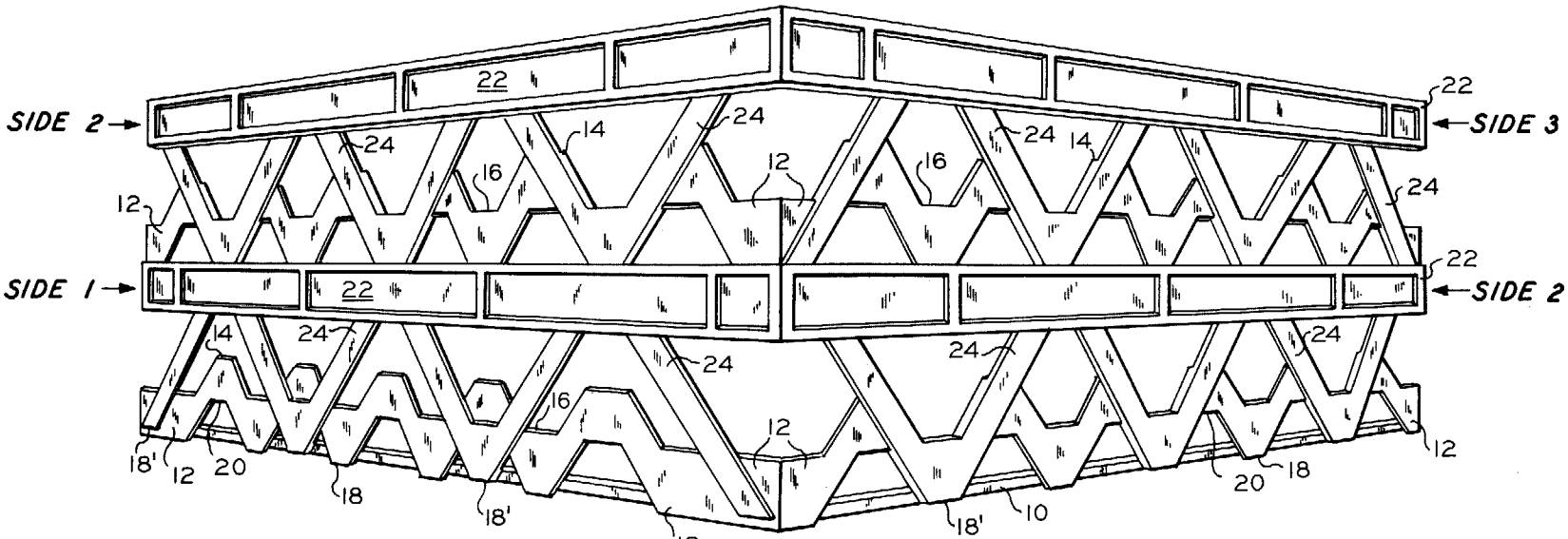

FIG. 10 is a side perspective view illustrating two containers of the invention in a substantially fully elevated stacked relationship.

Figure 11:
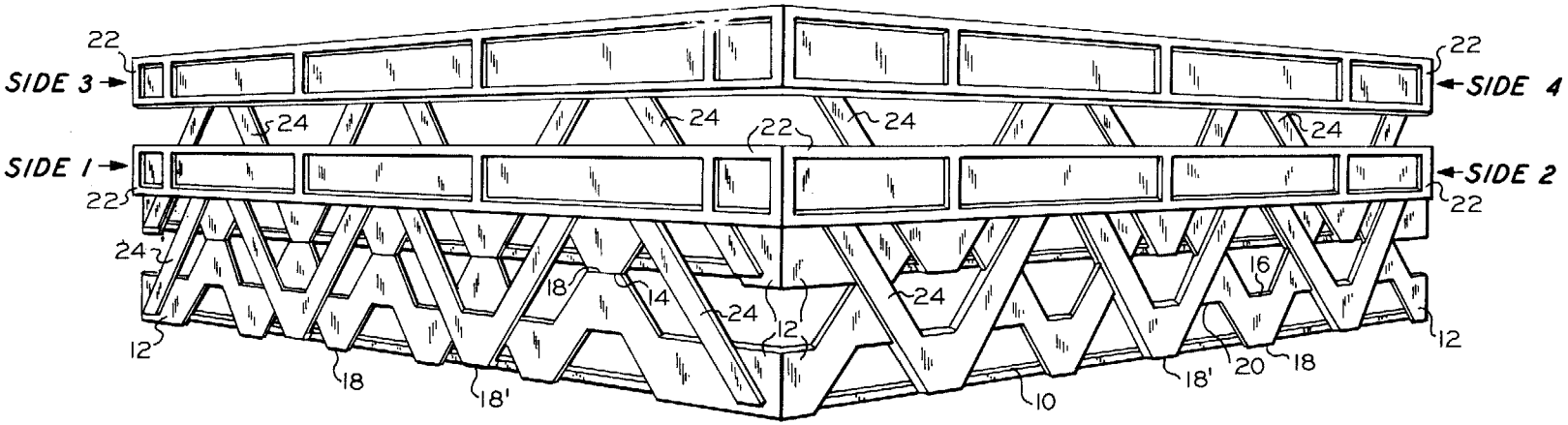

FIG. 11 is a side perspective view illustrating two containers of the invention in a partially elevated stacked relationship.

Figure 12:
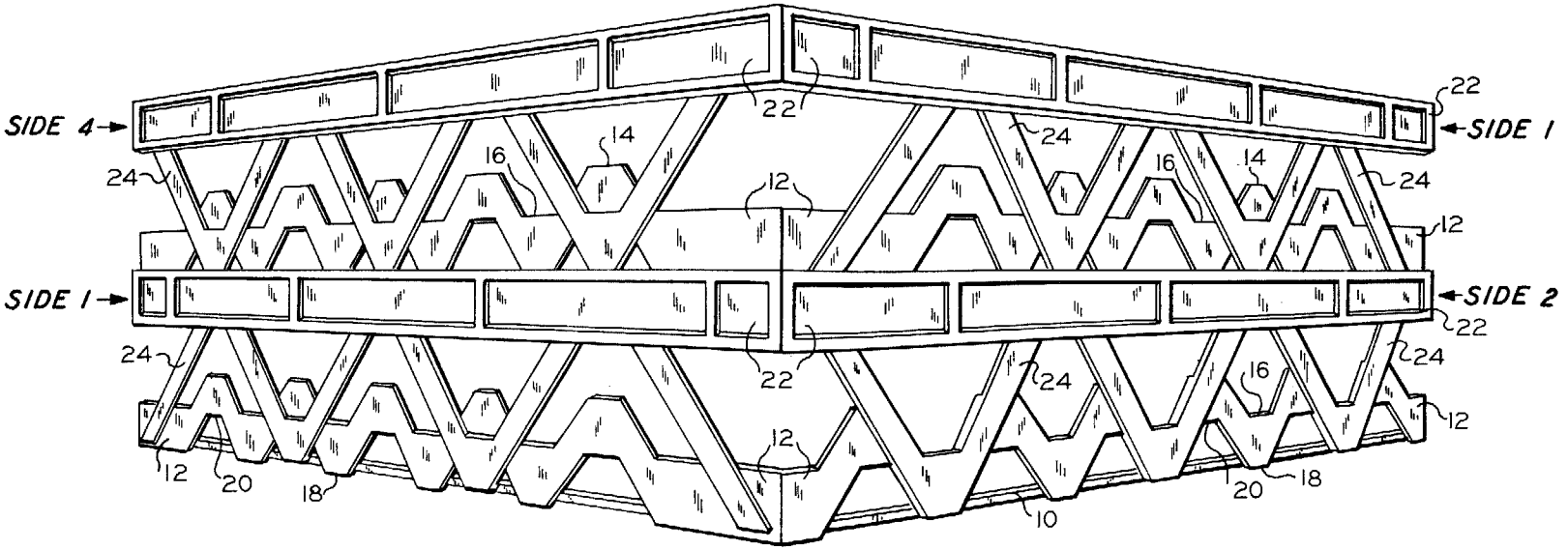

FIG. 12 is a side perspective view illustrating two containers of the invention in another substantially fully elevated stacked relationship.

Figure 13:
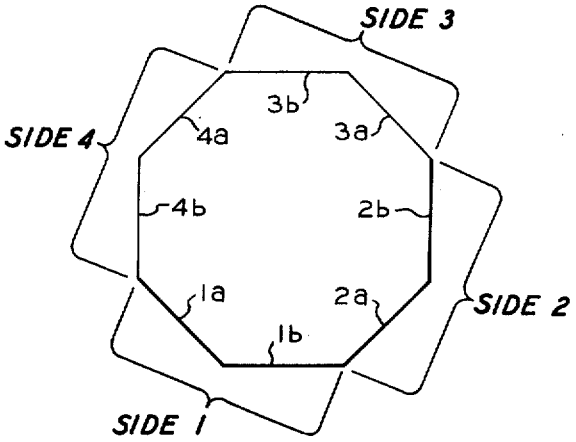

FIG. 13 is a diagrammatic illustration of another peripheral form which can be provided in the containers of the invention.

Referring now to the drawings wherein like reference numerals are employed to denote like elements, the containers of the invention will be more fully described with particular reference to said presently preferred embodiment. In FIGS. 1–12, the container there illustrated comprises, in one embodiment of the invention, a symmetrical essentially square container. Said container is provided with a generally horizontally disposed bottom. Said bottom will preferably comprise a suitable gridwork, here denoted generally by the reference numeral 10. Said bottom can comprise any other suitable bottom means such as a planar sheet, a perforated planar sheet, etc.

First, second, third, and fourth adjacent dissimilar sidewall structures extend upwardly to essentially the same height from adjacent essentially equal length first, second, third, and fourth sides, respectively, of said bottom. Said sidewall structures are denoted generally as side one, side two, side three, and side four, respectively.

Preferably, one of said sidewall structures will comprise a border flange 12 extending along a said side of said bottom 10 in a first vertical plane which is located adjacent said side of said bottom 10. In a presently preferred embodiment said border flange 12 will be sinuous in shape and comprise a series of upstanding alternating peaks 14 and valleys 16 along its upper surface or top, and a series of inverted alternating peaks 18 and valleys 20 along its lower urface or bottom.

The apex areas of said inverted peaks 18 comprise a first plurality of stacking feet disposed at spaced apart locations along said side of said bottom 10 and in said first vertical plane. Preferably, the bottoms of said apex areas (stacking feet) are at the same elevation as the bottom of the end segments of said border flange 12 and are provided with flat bottom surfaces. By employing this structure, said stacking feet will provide intermediate support when a container is sitting on a flat surface.

The apex areas of said upstanding peaks 14 comprise a first plurality of stacking saddles disposed at spaced apart locations along said side of said bottom 10 and in said first vertical plane. Said first stacking feet and said first stacking saddles are thus disposed at alternating spaced apart locations.

Preferably, each of the above-described peaks and valleys is generally rectilinear in shape. It is also preferred that the apex area of each of said peaks, and the bottom of each of said valleys therebetween, be generally horizontal. However, it is within the scope of the invention for said peaks and valleys to be curvilinear in shape. It will be understood in view of this disclosure that said peaks and valleys should be of a shape and size relative to each other, preferably complementary, to permit registration and cooperation in nesting and stacking as illustrated in FIGS. 9–12.

Preferably, each of said wall structures also comprises an upper rim 22 which is disposed generally vertically above said side of said bottom 10 and in a third vertical plane which is adjacent but outside said second vertical plane. It will be noted that each of said upper rims is longer than the side of the bottom 10 above which it is disposed. This structure results in the upper periphery (top) of the container being greater than the lower periphery (bottom) of the container. Thus, in stacked relationship the bottom periphery of an upper container will be confined within upper periphery of a lower container and thus stabilize a stack of containers with respect to transverse movements. Said upper rims 22, being disposed in said third vertical plane, (the outermost vertical plane extending through the container), present a substantially flat surface to an adjacent container when two containers are side by side at the same elevation. The outer surfaces of said upper rims 22 thus prevent interlocking of adjacent containers as sometimes happens when ends or sides of corrugated container contact each other, as when traveling on a conveyor belt. Said upper rims 22 also provide convenient handles for handling the containers, without the necessity for providing special openings which sometimes weaken the wall structure of prior art containers.

A plurality of spaced apart bar members 24 is disposed in said second vertical plane in each said wall structure and each bar member extends in a generally upward direction between the outer surface of said border flange 12 and the inner surface of said upper rim 22. The bottom of each of said bar members comprises a stacking foot 18' in said second plurality of stacking feet, and the top of each of said bar members comprises a stacking saddle 14' in said second plurality of stacking saddles. Preferably, each of said bar members is inclined with respect to the vertical. More preferably, said bar members in each of said wall structures are successively inclined in opposite directions with respect to each other, with adjacent bar members being joined at the adjacent ends thereof to provide a series of alternate generally V-shaped forms and inverted generally V-shaped forms.

When adjacent said bar members are joined at adjacent ends thereof to form said V-shaped forms, the apex area of each of said inverted generally V-shaped forms comprises a said stacking saddle 14' in said second plurality of stacking saddles (see FIG. 1), and the apex area of each of said generally V-shaped forms comprise a said stacking foot 18' in said second plurality of stacking feet (see FIGS. 1, 3–6, and 9–12). Preferably, said apex areas of both types of said V-shaped forms are generally horizontal.

Preferably, each of said apex areas comprising a stacking foot 18' in said second plurality of stacking feet is provided with a longitudinally extending recess 26 therein. In a preferred embodiment of said recess is formed along one side of the apex area and adjacent said border flange 12. See FIGS. 7 and 8. It is also preferred that each of said apex areas comprising a stacking saddle 14' in said second plurality of stacking saddles be provided with an elevated longitudinally extending crown 28 thereon with said crown having a shape corresponding generally to the shape of said recesses in said apex areas comprising stacking feet. In a preferred embodiment said crowns will be formed along one side of said apex areas and spaced apart from the inner surface of said upper rim 22. See FIGS. 7 and 8.

The apex area of each of said peaks formed in said border flange is preferably generally flat, and the bottom of each of said valleys is preferably generally flat. However, it is within the scope of the invention for the apex area of said inverted peaks 18 comprising a stacking foot to be provided with a recess therein, similarly as described above for the apex areas comprising the bottoms of said inclined bars. It is also within the scope of the invention for the apex area of said upstanding peaks 14 to be provided with a crown, similarly as described above for the apex area comprising the tops of said inclined bars.

In one presently preferred embodiment of the invention the inclined bar members 24 in a said first wall structure, such as side one in FIGS. 1 and 3, comprise three pairs of bars and each said pair of bars provides an inverted generally V-shaped form in said second vertical plane, and an upstanding peak 14 of said border flange 12 is disposed in the general area between the bars of each said inverted V-shaped form but in said first vertical plane. In a second wall structure (counting counterclockwise) of said presently preferred embodiment the inclined bar members 24 comprise three pairs of bars and each said pair of bars provides a generally V-shaped form in said second vertical plane, and an inverted peak 18 of said border flange 12 is disposed in the general area between adjacent said V-shaped forms but in said first vertical plane. See, for example, side two in FIGS. 1 and 4. In a third wall structure (counting counterclockwise) of said preferred embodiment, the inclined bars 24 comprise three pairs of bars and each said pair of bars provides a said inverted generally V-shaped form in said second vertical plane, and an inverted peak 18 of said border flange 12 is disposed in the general area between the bars of each said inverted V-shaped form but in said first vertical plane. See, for example, side three in FIG. 5. In a fourth wall structure (counting counterclockwise) of said preferred embodiment the inclined bar members 24 comprise three pairs of bars and each said pair of bars provides a generally V-shaped form in said second vertical plane, and an upstanding peak 14 of said border flange 12 is disposed in the general area between the bars of each said V-shaped form but in said first vertical plane. See, for example, side four in FIG. 6.

In the preferred embodiments of the invention it is preferred that portions of said border flange 12 extend generally vertically above and below the horizontal plane of said bottom 10.

From the above description of the containers of the invention, and the illustrations thereof in the drawings, it is clear that the location, arrangement, and lateral spacing of said first stacking feet and said first stacking saddles with respect to each other and to said second stacking feet and said second stacking saddles, together with the location, arrangement, and lateral spacing of said second stacking feet and said second stacking saddles with respect to each other and to said first stacking feet and said first stacking saddles is such that an upper container will nest within a like lower container when said containers are in like positions of orientation. It is also clear that said second stacking feet and said second stacking saddles in at least two opposed wall structures are adapted to register and to support an upper container in a first stacked relationship on a like lower container when said upper container is rotated from said position of like orientation to a first station of rotation. Similarly, said first stacking feet and said first stacking saddles located in said first plane in at least two opposed wall structures are adapted to register and to support an upper said container in a second stacked relationship on a like lower container at a lower elevation than that of said first stacked relationship when said upper container is further rotated to a second succeeding station of rotation.

Thus, for example, in the presently preferred containers of the invention, an upper said container will nest in nested relationship with a like lower container when said containers are in identical positions of orientation with the lower surfaces of the border flange 12 of said upper container adjacent the upper surfaces of the border flanges 12 of said lower container in said first plane, and with the corresponding inclined bar members 24 of like wall structures paralleling each other (see FIG. 9), said second stacking feet 18' and said second stacking saddles 14' in said second vertical plane in at least two opposed said wall structures will register and support said upper container in a substantially fully elevated stacked relationship on said lower container when said upper container is rotated clockwise 90 degrees from said position or like orientation to a first station of rotation (see FIG. 10); said first stacking feet 18 and said first stacking member 14 in said first vertical plane in at least two opposed said wall structures will register and support said upper container in a partially elevated stacked relationship on said lower container when said upper container is further rotated clockwise 90 degrees from said first station of rotation to a second station of rotation (see FIG. 11); said second stacking feet 18' and said second stacking saddles 14' in said second vertical plane in at least two opposed said wall structures will register and support said upper container in a substantially fully elevated stacked relationhip on said lower container when said upper container is further rotated clockwise 90 degrees from said second station of rotation to a third station of rotation (see FIG. 12); and said upper container will again nest in said nested relationship with said upper container is further rotated clockwise 90 degrees from said third station of rotation (see FIG. 9).

The containers of the invention have been described above with particular reference to a presently preferred container having an essentially square shape. However, the invention is not limited to essentially square-shaped containers. For example, FIG. 13 is a diagrammatic plan view illustrating a container in accordance with the invention and having an octagonal shape. In this embodiment of the invention, adjacent side walls such as 1*a* and 1*b*, 2*a* and 2*b*, etc. would comprise first, second, etc., respectively, wall structures in accordance with the invention. In such wall structures the junction between sides 1*a* and 1*b* would be at the midpoint of side 1 in FIG. 3, for example. Thus, the nesting and stacking characteristics of the containers remains as described above.

Those skilled in the art can now perceive, in view of this disclosure, how the containers of the invention can have still other shapes, e.g., circular. In circular containers the abovedescribed wall structures could be provided in adjacent segments or arcs of the circumference of the container.

However, for reasons of space economy in placing containers adjacent each other, particularly in trucks, the essentially square containers described above are preferred.

The containers of the invention can be fabricated in any suitable manner known to the art. Injection molding, for example, is one presently preferred method for fabricating said containers. Said containers can be fabricated from any suitable material. Higher density polyethylenes are especially desirable materials from which to fabricate said containers. The high density polyethylenes prepared by the methods disclosed and claimed by J. P. Hogan et al in U.S. Pat. NO. 2,825,721, issued Mar. 4, 1958, comprise one group of presently preferred materials. Said containers can also be fabricated from butadiene-styrene copolymers, and other plastic materials. If desired, a reinforcing fibrous material, such as asbestos or glass fibers, can be incorporated in the plastic material. While the various plastics are presently preferred for the manufacture of the containers, it is within the scope of the invention to fabricate said containers from other materials, e.g., lightweight metals such as aluminum, reinforced pulp materials, etc.

As an example, in one model of a container in accordance with the invention the overall side length, measured at the upper rim, is about 23 inches. The overall side length, measured from the inner surfaces of the bottom border flange 12 is about 21 inches. The width or height of said upper rim is about 1.75 inches. The overall width or height of said border flange 12 is about 2.8 inches, and the overall height of the container is about 6.25 inches. The width of the inclined bars in said wall structures is about 0.75 inches. The dimensions of the other elements of the container are generally proportional in size.

While certain embodiments of the invention have been described for illustrative purposes, the invention is not limited thereto. Various other modifications or embodiments of the invention will be apparent to those skilled in the art in view of this disclosure. Such modifications or embodiments are within the spirit and scope of the disclosure.

I claim:

1. A symmetrical nesting and stacking container comprising:

a generally horizontally disposed bottom; and a plurality of adjacent dissimilar wall structures extending upwardly to essentially the same height from adjacent essentially equal length peripheral segments of said bottom located around the periphery of said bottom; with each of said wall structures comprising:

a sinuously shaped border flange extending along said peripheral segment of said bottom in a first vertical plane located adjacent said peripheral segment;

said border flange comprising a series of upstanding alternating peaks and valleys along its upper surface and a series of inverted alternating peaks and valleys along its lower surface, with the apex areas of said inverted peaks comprising a first plurality of spaced apart stacking feet located in said first plane, and the apex areas of said upstanding peaks comprising a first plurality of spaced apart stacking saddles located in said first plane;

an upper rim disposed generally vertically above said border flange and in a third vertical plane which is adjacent but outside a second vertical plane described hereinafter;

a plurality of spaced apart bar members, disposed in said second vertical plane which is adjacent but outside said first vertical plane, and extending in an upwardly inclined direction between the outer surface of said border flange and the inner surface of said upper rim;

the bottom of each of said bar members comprising a stacking foot in a second plurality of spaced apart stacking feet located in said second plane, and the top of each of said bar members comprising a stacking saddle in a second plurality of spaced apart stacking saddles located in said second plane;

the location, arrangement, and lateral spacing of said first feet and said first saddles with respect to each other and to said second feet and said second saddles, together with the location, arrangement, and lateral spacing of said second feet and said second saddles with respect to each other and to said first feet and said first saddles being such that an upper said container will nest within a like lower container when said containers are in like positions of orientation;

said second feet and said second saddles in at least two opposed said wall structures being adapted to register and to support an upper said container in a first stacked relationship on a like lower container when said upper container is rotated from said position of like orientation to a first station of rotation; and said first feet and said first saddles in at least two opposed said wall structures being adapted to register and to support an upper said container in a second stacked relationship on a like lower container at a lower elevation than that of said first stacked relationship when said upper container is further rotated to a second succeeding station of rotation.

2. A container according to claim 1 wherein:

each of said peaks and valleys is generally rectilinear in shape;

the apex area of each of said peaks and the bottom of each of said valleys are generally horizontal;

said bar members are successively inclined in opposite directions with respect to each other, with adjacent bar members joined at the adjacent ends thereof to provide a series of alternate generally V-shaped forms and inverted generally V-shaped forms;

the apex area of each of said inverted generally V-shaped forms comprises a stacking saddle in said second plurality of stacking saddles;

the apex area of each of said generally V-shaped forms comprises a stacking foot in said second plurality of stacking feet; and said apex areas of both types of said V-shaped forms are generally horizontal.

3. A symmetrical essentially square nesting and stacking container comprising a generally horizontally disposed bottom and first, second, third, and fourth adjacent dissimilar side wall structures extending upwardly to essentially the same height from adjacent essentially equal length first, second, third, and fourth sides, respectively, of said bottom, with each of said wall structures comprising:

a sinuously shaped border flange extending along a said side of said bottom in a first vertical plane located adjacent said side of said bottom;

said border flange comprising a series of upstanding alternating peaks and valleys along its upper surface and a series of inverted alternating peaks and valleys along its lower surface, with the apex areas of said inverted peaks comprising a first plurality of spaced apart stacking feet located in said first plane, and the apex areas of said upstanding peaks comprising a first plurality of spaced apart stacking saddles located in said first plane;

an upper rim disposed generally vertically above said border flange and in a third vertical plane which is adjacent but outside a second vertical plane described hereinafter;

a plurality of spaced apart bar members, disposed in said second vertical plane which is adjacent but outside said first vertical plane, and extending in an upwardly inclined direction between the outer surface of said border flange and the inner surface of said upper rim;

the bottom of each of said bar members comprising a stacking foot in a second plurality of spaced apart stacking feet located in said second plane, and the top of each of said bar members comprising a stacking saddle in a second plurality of spaced apart stacking saddles located in said second plane;

the location, arrangement, and lateral spacing of said first feet and said first saddles with respect to each other and with respect to said second feet and said second saddles, together with the location, arrangement, and lateral spacing of said second feet and said second saddles with respect to each other and with respect to said first feet and said first saddles being such that an upper said container will nest within a like lower container when said containers are in like positions of orientation;

said second feet and said second saddles in at least two opposed said wall structures being adapted to register and to support an upper said container in a first stacked relationship on a like lower container when said upper container is rotated from said position of like orientation to a first station of rotation; and said first feet and said first saddles in at least two opposed said wall structures being adapted to register and to support an upper said container in a second stacked relationship on a like lower container at a lower elevation than that of said first stacked relationship when said upper container is further rotated to a second succeeding station of rotation.

4. A container according to claim 3 wherein:

each said stacking foot in said second plurality of stacking feet comprises a recess in the bottom of one of said bar members; and each said stacking saddle in said second plurality of stacking saddles comprises an elevated crown, having a shape corresponding generally to the shape of said recesses in the bottoms of said bar members, on the top of one of said bar members.

5. A container according to claim 3 wherein:

each of said peaks and valleys is generally rectilinear in shape;

the apex area of each of said peaks and the bottom of each of said valleys are generally horizontal;

said bar members are successively inclined in opposite directions with respect to each other, with adjacent bar members joined at the adjacent ends thereof to provide a series of alternate generally V-shaped forms and inverted generally V-shaped forms;

the apex area of each of said inverted generally V-shaped forms comprises a stacking saddle in said second plurality of stacking saddles;

the apex area of each of said generally V-shaped forms comprises a stacking foot in said second plurality of stacking feet; and said apex areas of both types of said V-shaped forms is generally horizontal.

6. A container according to claim 5 wherein:

each of said apex areas comprising a stacking foot in said second plurality of stacking feet is provided with a longitudinally extending recess therein;

each of said apex areas comprising a stacking saddle in said second plurality of stacking saddles is provided with an elevated longitudinally extending crown thereon having a shape corresponding generally to the shape of said recesses in said apex areas comprising stacking feet;

said apex area of each of said peaks is generally flat; and the bottom of each of said valleys is generally flat.

7. A container according to claim 5 wherein:

said bar members in said first wall structure comprise three pairs of bars and each said pair of bars provides a said inverted generally V-shaped form in said second vertical plane, and an upstanding peak of said border flange is disposed in the general area between the bars of each said inverted V-shaped form but in said first vertical plane;

said bar members in said second wall structure counting counterclockwise comprise three pairs of bars and each said pair of bars provides a said generally V-shaped form in said second vertical plane, and an inverted peak of said border flange is disposed in the general area between adjacent said V-shaped forms but in said first vertical plane;

said bar members in said third wall structure counting counterclockwise comprise three pairs of bars and each said pair of bars provides a said inverted generally V-shaped form in said second vertical plane, and an inverted peak of said border flange is disposed in the general area between the bars of each said inverted V-shaped form but in said first vertical plane; and said bar members in said fourth wall structure counting counterclockwise comprise three pairs of bars and each said pair of bars provides a generally V-shaped form in said second vertical plane, and an upstanding peak of said border flange is disposed in the general area between the bars of each said V-shaped form but in said first vertical plane.

8. A container according to claim 7 wherein portions of said border flange extend generally vertically above and below the plane of said bottom.

9. A container according to claim 7 wherein:

an upper said container will nest in nested relationship within a like lower container when said containers are in identical positions of orientation with the lower surfaces of the border flanges of said upper container adjacent the upper surfaces of the border flanges of said lower container in said first plane, and with the corresponding inclined bar members of like wall structures paralleling each other;

said second stacking feet and said second stacking saddles in said second vertical plane in at least two opposed said wall structures will register and support said upper container in a substantially fully elevated relationship on said lower container when said upper container is rotated clockwise 90° from said position of like orientation to a first station of rotation;

said first stacking feet and said first stacking saddles in said first vertical plane in at least two opposed said wall structures will register and support said upper container in a partially elevated stacked relationship on said lower container when said upper container is further rotated clockwise 90° from said first station of rotation to a second station of rotation;

said second stacking feet and said second stacking saddles in said second vertical plane in at least two opposed said wall structures will register and support said upper container in a substantially fully elevated stacked relationship on said lower container when said upper container is further rotated clockwise 90° from said second station of rotation to a third station of rotation; and said upper container will again nest in said nested relationship when said upper container is further rotated clockwise 90° from said third station of rotation.

10. A container according to claim 9 wherein:

in said nested relationship said first, second, third, and fourth wall structures of said upper container are nested in said first, second, third, and fourth wall structures, respectively, of said lower container;

in said first mentioned substantially fully elevated stacked relationship said second and fourth wall structures of said upper container are supported on said first and third wall structures, respectively, of said lower container;

in said partially elevated stacked relationship said third and first wall structures of said upper container are supported on said first and third wall structures, respectively, of said lower container; and in said second mentioned substantially fully elevated stacked relationship said fourth and second wall structures of said upper container are supported on said first and third wall structures, respectively, of said lower container.

* * * * *

UNITED STATES PATENT AND TRADEMARK OFFICE

CERTIFICATE OF CORRECTION

PATENT NO. : 3,937,327

DATED : February 10, 1976

INVENTOR(S) : James C. Carroll

It is certified that error appears in the above-identified patent and that said Letters Patent are hereby corrected as shown below:

Column 12, claim 9, line 1, after "elevated" the word --- stacked --- should be inserted.

Signed and Sealed this

Third Day of May 1977

[SEAL]

*Attest:*

RUTH C. MASON
*Attesting Officer*

C. MARSHALL DANN
*Commissioner of Patents and Trademarks*